US010087709B2

(12) United States Patent
Padilla et al.

(10) Patent No.: US 10,087,709 B2
(45) Date of Patent: Oct. 2, 2018

(54) WELL CEMENTING METHODS AND APPARATUSES

(71) Applicant: BAKER HUGHES INCORPORATED, Houston, TX (US)

(72) Inventors: Felipe Padilla, Tomball, TX (US); Shailesh S. Dighe, Katy, TX (US); Jeremy L. Weinstein, Tomball, TX (US); Toby J. Harkless, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/054,451

(22) Filed: Feb. 26, 2016

(65) Prior Publication Data

US 2017/0247975 A1 Aug. 31, 2017

(51) Int. Cl.
*E21B 33/14* (2006.01)

(52) U.S. Cl.
CPC ..... *E21B 33/14* (2013.01)

(58) Field of Classification Search
None
See application file for complete search history.

(56) References Cited

U.S. PATENT DOCUMENTS

| | | | |
|---|---|---|---|
| 4,654,802 A | 3/1987 | Davis | |
| 4,834,542 A | 5/1989 | Sherwood | |
| 5,289,877 A | 3/1994 | Naegele et al. | |
| 5,538,286 A | 7/1996 | Hoff | |
| 5,570,743 A | 11/1996 | Padgett et al. | |
| 5,571,281 A | 11/1996 | Allen | |
| 5,624,182 A | 4/1997 | Dearing, Sr. et al. | |
| 6,732,797 B1 | 5/2004 | Walters et al. | |
| 6,786,629 B2 | 9/2004 | Rondeau et al. | |
| 7,464,757 B2 | 12/2008 | Pessin et al. | |
| 2006/0221762 A1 | 10/2006 | Rondeau et al. | |
| 2010/0025041 A1 * | 2/2010 | Phillippi | E21B 21/07 166/310 |

(Continued)

OTHER PUBLICATIONS

Baker Hughes Incorporated; Falcon Cementing Unit, Overview; © 2012 Baker Hughes Incorporated 2012.

(Continued)

*Primary Examiner* — Anuradha Ahuja
(74) *Attorney, Agent, or Firm* — Parsons Behle & Latimer

(57) ABSTRACT

A well cementing method includes combining a spacer polymer with a liquid in a first mixer and producing a spacer polymer blend yielding a spacer pumped into a well using a product pump. The method includes combining a cement additive with the liquid in the first mixer and producing a cement additive blend yielding a wellbore cement pumped into the well following the spacer using the product pump. Another well cementing method includes combining a cement additive with a liquid in a first mixer and producing a cement additive blend. The method combines bulk cement materials and the cement additive blend in a second mixer and produces a wellbore cement pumped into a well.
A well cementing system includes a liquid pump, a first mixer, an additive feeder, a second mixer separate from the first mixer, a cement feeder, and a product pump.

19 Claims, 6 Drawing Sheets

(56) References Cited

U.S. PATENT DOCUMENTS

| | | | | |
|---|---|---|---|---|
| 2010/0032031 | A1* | 2/2010 | Neal | E21B 21/02 137/565.01 |
| 2013/0213647 | A1* | 8/2013 | Roddy | E21B 47/01 166/255.1 |
| 2014/0083699 | A1* | 3/2014 | Roddy | C09K 8/46 166/292 |
| 2014/0202702 | A1* | 7/2014 | Cobb | B01F 5/0614 166/307 |

OTHER PUBLICATIONS

Korean Intellectual Property Office; International Search Report and Written Opinion; PCT Patent Application No. PCT/US2017/017901 dated May 12, 2017.

* cited by examiner

WELL CEMENTING METHODS AND APPARATUSES

TECHNICAL FIELD

The embodiments described herein relate generally to well cementing methods and systems. More specifically, the embodiments described herein relate to well cementing systems and methods that may include mixing at a well-site.

BACKGROUND

The process of preparing wells drilled in subterranean formations, such as hydrocarbon production wells, often includes cementing the well. Known techniques for well cementing protect and seal the wellbore. Cementing may be used to seal the annulus between the wellbore wall and casing in the wellbore. Cementing may also be used to plug portions of a well, including for the purpose of abandonment, to seal a lost circulation zone, etc.

Known cementing systems and methods pre-mix bulk cement materials and cement additives in batch processes at an offsite location. A wide variety of additives may be included to provide desired time for setting the cement, density, viscosity, strength, etc. The blended mix must then be transported to the well-site. However, transporting the blended mix may cause settling of additives and other components due to inherent vibrations in the transportation process. In addition, use of the offsite location may result in operating downtime, leftover materials, increased costs, and increased time to mix a wellbore cement. Therefore, it may be desirable to provide bulk cement materials and cement additives in a different manner.

After drilling ceases and before cementing begins, static drilling mud in a wellbore may gel up and become difficult to remove. Often, a spacer fluid is provided between cement slurry and drilling mud to avoid commingling.

Known methods for batch mixing of spacer fluids require a system separate from the cementing system. As a result, a well-site requires additional units to perform both cementing and spacer operations. Often, during simultaneous operations, there are insufficient mixers to mix the spacer and operations may be delayed. Therefore, it may be desirable to provide spacer fluid in a different manner.

SUMMARY

A well cementing method includes drawing a liquid from a liquid source. The liquid may be drawn to a liquid pump using the liquid pump. The method includes pumping a portion or all of the liquid to a first mixer using the liquid pump. The method includes supplying a spacer polymer to the first mixer and combining the spacer polymer with the liquid and producing a spacer polymer blend. The spacer polymer may be substantially dry. The method includes producing a spacer from the spacer polymer blend and pumping the spacer into a well using a product pump. The method includes supplying a cement additive to the first mixer and combining the cement additive with the liquid to produce a cement additive blend. The cement additive may be substantially dry. The method further includes producing a wellbore cement from the cement additive blend and pumping the wellbore cement into the well following the spacer using the product pump.

A well cementing method includes drawing a liquid from a liquid source to a liquid pump using the liquid pump. The method includes pumping a portion or all of the liquid to a first mixer using the liquid pump. The method includes supplying a cement additive to the first mixer and combining the cement additive with the liquid and producing a cement additive blend. The method includes supplying bulk cement materials to a second mixer and therein combining the bulk materials and the cement additive blend and producing a wellbore cement. The wellbore cement is pumped into the well using a product pump.

A well cementing system includes a liquid pump, a first mixer, an additive feeder, a second mixer, and a cement feeder. A liquid discharge line exists from the liquid pump to the first mixer. An additive discharge path exists from the additive feeder to the first mixer. The first mixer is configured to combine liquid and additive to produce an additive blend. A blend discharge line exists from the first mixer to the second mixer. A cement discharge path exists from the cement feeder to the second mixer. The second mixer is configured to combine the additive blend and bulk cement to produce wellbore cement. The well cementing system further includes a product pump and a feed line from the second mixer to the product pump.

BRIEF DESCRIPTION OF THE DRAWINGS

Some embodiments are described below with reference to the following accompanying drawings.

DETAILED DESCRIPTION

Figure 1:
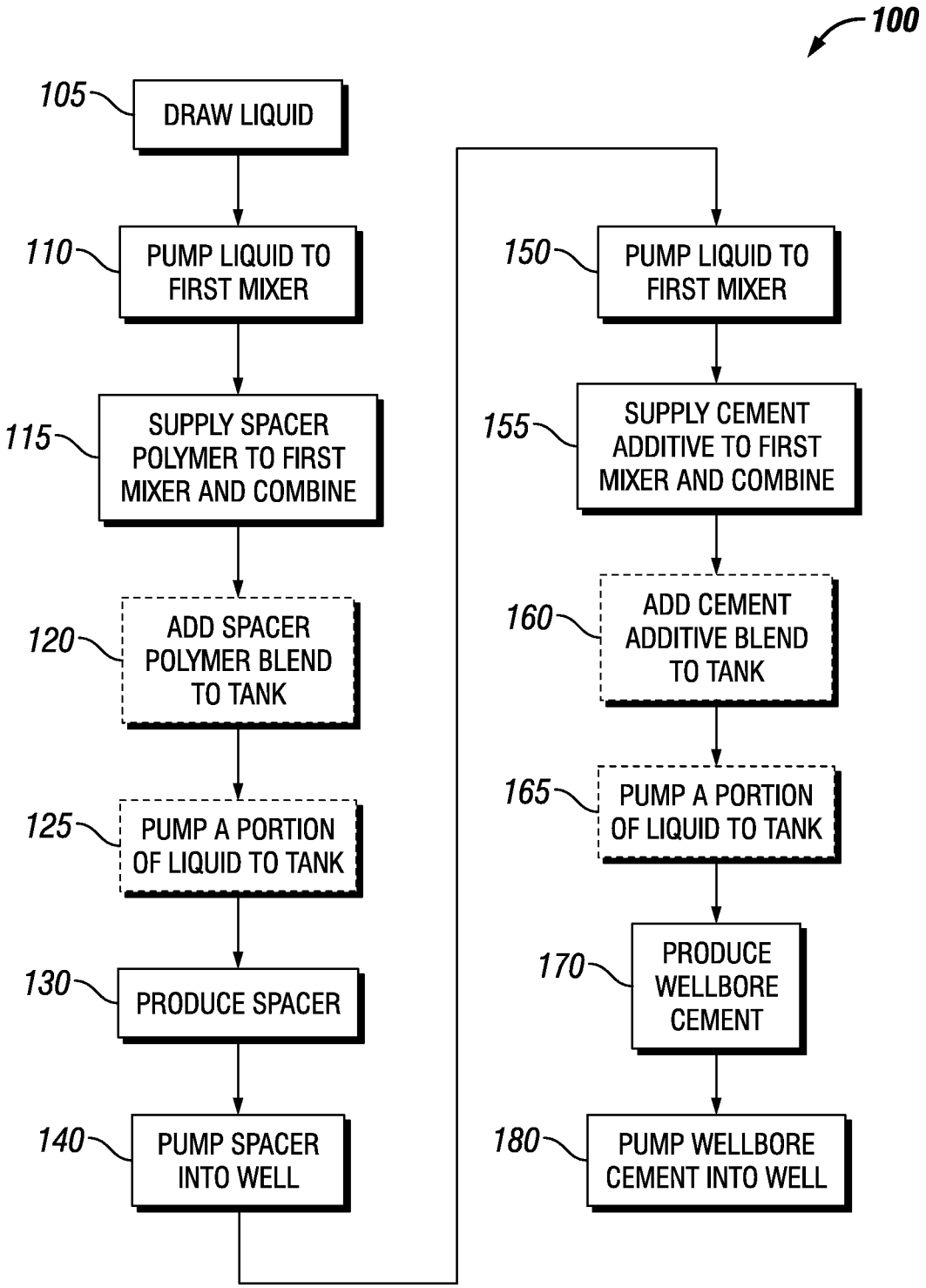
FIGS. 1 and 2 are flow diagrams showing well cementing methods.

The systems and methods herein overcome some of the problems and disadvantages discussed above, including those associated with batch mixing. To reduce energy consumption and preparation time, and limit waste materials, additives for a wellbore cement may be introduced as needed at the well-site. The cement additives may be combined with a liquid on-the-fly and, subsequently, bulk cement materials may be combined with the cement additive blend.

Waste materials due to transportation and off-site mixing and preparation of bulk cement materials pre-mixed with cement additives may be reduced with the systems and methods herein. Moreover, the wellbore cement may have a more homogenous consistency and properties may be adjusted in real time.

In addition, a well cementing system may integrate on-the-fly combination of liquid and polymer to produce a spacer using the same or intersecting components of the cementing system. Accordingly, production down-time may be reduced and fewer on-site units may be needed to perform the operation, reducing the operation footprint.

According to an embodiment, a well cementing method includes drawing a liquid from a liquid source. The liquid may be drawn to a liquid pump using the liquid pump. The method includes pumping a portion or all of the liquid to a first mixer using the liquid pump. The method includes supplying a spacer polymer to the first mixer and combining the spacer polymer with the liquid and producing a spacer polymer blend. In other words, the spacer polymer may be mixed on-the-fly with the liquid in the first mixer. The spacer polymer may be substantially dry in that it may have some water content from residual moisture during production or absorption of atmospheric moisture, but is a free-flowing solid. The method includes producing a spacer from the spacer polymer blend and pumping the spacer into a well using a product pump.

The method includes supplying a cement additive to the first mixer and therein combining the cement additive with the liquid and producing a cement additive blend. In other words, the cement additive may be mixed on-the-fly with the liquid in the first mixer. The cement additive may be substantially dry in the same sense as the spacer polymer. The method further includes producing a wellbore cement from the cement additive blend and pumping the wellbore cement into the well following the spacer. The wellbore cement may be pumped into the well using the same product pump used to pump the spacer into the well.

By way of example, all of the liquid may be pumped to the first mixer. Alternatively, a portion of the liquid may be pumped to the first mixer and the method may include pumping another portion of the liquid into a tank. The other portion may be pumped into the tank using the liquid pump. The method may include adding the spacer polymer blend into the tank. The method may include combining the other portion of the liquid with the spacer polymer blend, therein decreasing a ratio of spacer polymer to the liquid within the tank. The method may further include adding the cement additive blend into the tank separately from the spacer polymer blend. The method may include combining the other portion of the liquid with the cement additive blend, therein decreasing a ratio of cement additive to liquid within the tank.

The liquid may be water. The polymer may be a liquid blend or dry with quick hydration properties. The polymer may have thermal stability at low and high temperatures. The cement additive may include a material selected from retarders, surfactants, fluid loss agents, dispersants, antifoam agents, cement accelerators, foamers, foam stabilizers, salts, bonding agents, extenders, weighting agents, gas migration agents, expanding, loss circulation materials, swelling/sealing agents, anti-settling, strength retrogression, mechanical properties enhancers, and combinations thereof in accordance with the known usage for such terms in the petroleum industry.

The spacer polymer and the cement additive may be supplied separately to the first mixer. The spacer polymer and the cement additive may be supplied using a same additive feeder. The method may further including supplying a bulk cement material to a second mixer and therein combining the bulk cement material and the cement additive blend to produce the wellbore cement. The first mixer and the second mixer may be the same mixer. The same mixer may be configured to combine the spacer polymer with the liquid and later to combine the cement additive and the liquid with the bulk cement materials.

According to another embodiment, a well cementing method includes drawing a liquid from a liquid source. The liquid may be drawn to a liquid pump using the liquid pump. The method includes pumping a portion or all of the liquid to a first mixer using the liquid pump. The method includes supplying a cement additive to the first mixer and combining the cement additive with the liquid and producing a cement additive blend. In other words, the cement additive may be mixed on-the-fly with the liquid in the first mixer. The method includes supplying bulk cement materials to a second mixer and therein combining the bulk materials and the cement additive blend and producing a wellbore cement. In other words, the cement additive blend may be mixed on-the-fly with the bulk cement materials in the second mixer. The wellbore cement is pumped into the well using a product pump.

By way of example, the method may include supplying a spacer polymer to the first mixer and combining the spacer polymer with the liquid. The combination of spacer polymer and liquid may be used to produce a spacer polymer blend. The method may include producing a spacer from the spacer polymer blend. The spacer may be pumped into the well using the product pump. That is, the product pump is the same product pump used to pump the wellbore cement into the well.

All of the liquid may be pumped to the first mixer. Alternatively, a portion of the liquid may be pumped to the first mixer and another portion of the liquid may be pumped into a tank. The other portion may be pumped into the tank using the liquid pump. The method may include adding the cement additive blend into the tank. The portion of the liquid may be pumped into the tank and combined with the cement additive blend, therein decreasing a ratio of cement additive to the liquid within the tank. The method may further include adding the spacer polymer blend into the tank separately from the cement additive blend. The portion of the liquid may be pumped into the tank and combined with the spacer polymer blend, therein decreasing a ratio of spacer polymer to liquid within the tank. A residency period within the tank may further integrate the spacer polymer into the liquid, for example, by hydrating the polymer, and produce the spacer.

The method may include selectively isolating the second mixer from the tank. The second mixer may be isolated from the tank before the spacer polymer blend is received into the tank. The method may include pumping the spacer into the well using the product pump and bypassing the second mixer. The product pump may receive flow from the tank.

The first mixer may be separate from the second mixer. Alternatively, the first mixer and the second mixer may be the same mixer. The same mixer may be configured to combine the spacer polymer with the liquid and later to combine the cement additive and the liquid with the bulk cement materials.

With the first mixer separate from the second mixer, even though a cement additive is combined with the liquid in the first mixer, another cement additive may be combined with the bulk cement materials in the second mixer. The cement additives referenced herein may include silica (e.g. silica sand, silica flour, or silica of other particle sizes), such as for reducing strength retrogression, and/or a weighting agent (e.g. barite or hematite). Often, the content of silica and/or weighting agent in wellbore cement is much higher than the content of other cement additives, such as more than 10 times the content. As a result, silica and/or weighting agent may be best combined with the cement additive blend in the second mixer along with the bulk cement materials, which also have a much higher comparable content. In this manner, the cement additive, silica, weighting agent, and bulk cement materials may all be mixed on-the-fly.

According to an embodiment, a well cementing system includes a liquid pump, a first mixer, an additive feeder, a second mixer, and a cement feeder. A liquid discharge line exists from the liquid pump to the first mixer. An additive discharge path exists from the additive feeder to the first mixer. A discharge "path" is indicated instead of a "line" to indicate that a variety of material conduits in addition to known piping, as often used for liquid in a "line," may be used to route the additive to the mixers described herein.

The first mixer is configured to combine liquid and additive to produce an additive blend. A blend discharge line exists from the first mixer to the second mixer. A cement discharge path exists from the cement feeder to the second mixer. The second mixer is configured to combine the additive blend and bulk cement to produce wellbore cement. The well cementing system further includes a product pump and a feed line from the second mixer to the product pump.

By way of example, the additive feeder may be further configured to supply a spacer polymer to the first mixer separate from the cement additive. The well cementing system may include a polymer feeder configured to supply a spacer polymer to the first mixer separate from the cement additive. The first mixer may be configured to combine liquid and spacer polymer to produce a spacer polymer blend. The first mixer may be separate from the second mixer. The separate first mixer may be configured to combine the spacer polymer with the liquid and later to combine the cement additive and the liquid.

The blend discharge line may include a blend tank. The liquid discharge line of the liquid pump may be connected to both the first mixer and the blend tank. The liquid discharge line of the liquid pump may be configured to direct a first flow of liquid to the first mixer and a second flow of liquid to the blend tank. The well cementing system may include a spacer line configured to carry a spacer from the blend tank to the product pump.

The feed line from the second mixer to the product pump may include a slurry tank and a slurry pump. A feed line exists from the second mixer to the slurry tank. Another feed line exists from the slurry tank to the slurry pump. A discharge line exists from the slurry pump to the product pump.

The features, functions, and advantages that have been discussed can be achieved independently in various embodiments or may be combined in yet other embodiments further details of which can be seen with reference to the following description and drawings. The process diagrams of FIGS. 3-6 are shown without valves, instrumentation, and control mechanisms for simplicity. However, those of ordinary skill with benefit of the present disclosure will readily appreciate a variety of ways to incorporate valves, instrumentation, and control mechanisms to practice the methods herein and to implement the systems herein.

For example, embodiments herein may be incorporated into existing cementing units, such as self-contained cementing units, including a FALCON™ cementing unit, which is trailer-mounted, available from Baker Hughes, Inc. in Houston, Tex. The incorporation into an existing cementing unit may be accomplished by modifying the existing unit to include the additional components of an embodiment within the same footprint as the existing unit, such as within a self-contained cementing unit. Alternatively, the additional components of an embodiment may be connected to the existing unit to pass materials therebetween, but comprise a separate subunit or multiple separate subunits outside the footprint of the existing unit. Also, the systems herein may be implemented as wholly new systems without modifying an existing unit though with the same options of a single self-contained unit or multiple interconnected, separate subunits.

FIG. 1 shows a flow diagram of a well cementing method 100 according to one embodiment. Action 105 includes drawing a liquid from a liquid source. The liquid may be drawn to a liquid pump using the liquid pump. Action 110 includes pumping a portion of or all of the liquid to a first mixer. The liquid may be pumped to the first mixer using the liquid pump. Action 115 includes supplying a spacer polymer to the first mixer and combining the spacer polymer with the liquid to produce a spacer polymer blend. The spacer polymer may be substantially dry. By way of example, the spacer polymer may be a water-soluble polymer and the liquid may be water. Well cementing method 100 may include passing the spacer polymer blend through a flow meter and monitoring the blend. A weighting agent may be added to the spacer polymer blend. Examples of weighting agents include barite, hematite, and manganese oxides to increase spacer density to assist in displacing drilling mud. In action 130, a spacer is produced from the spacer polymer blend. The spacer is pumped into a well using a product pump in action 140.

Although actions 105 to 140 are represented as occurring sequentially, they are performed in a continuous process. That is, actions 105 to 140 occur simultaneously once the process becomes established after startup. FIG. 1 thus represents the flow of the continuous process. A similar series of actions might be performed in the known batch mixing of spacer fluids described in the Background section above, but at least some of the actions would not occur simultaneously. For example, in a batch process, pumping spacer into the well would not occur while still combining liquid and spacer polymer. A batch of spacer polymer blend would be held until a spacer was produced from the whole batch before pumping into the well. As a result, with actions 105 to 140, the spacer polymer may be combined with the liquid on-the-fly while pumping the spacer into the well at the same time, as distinguished from batch processes.

Action 150 includes pumping the portion or all of the liquid to the first mixer. The liquid may be pumped to the first mixer using the liquid pump. Action 155 includes supplying a cement additive to the first mixer and combining the cement additive with the liquid to produce a cement additive blend. The cement additive may be supplied to the first mixer separate from the spacer polymer. The cement additive may be substantially dry. The cement additive blend may be used to produce a wellbore cement. In action 170, a wellbore cement is produced from the cement additive blend. Producing the wellbore cement may include supplying a bulk cement material to a second mixer and therein combining the bulk cement material and the cement additive blend to produce the wellbore cement. The first mixer and the second mixer may be the same mixer. The wellbore cement is pumped into a well using a product pump in step 180. The wellbore cement may follow a spacer. The product pump may be the same product pump used to pump the spacer into the well.

Although actions 150 to 180 are represented as occurring sequentially, they are performed in a continuous process. That is, actions 150 to 180 occur simultaneously once the process becomes established after startup. FIG. 1 thus represents the flow of the continuous process. Some similar actions might be performed in the known batch processes of cementing systems described in the Background section above, but at least some of the actions would not occur simultaneously. For example, in a batch process, pre-mixing of cement additive and bulk cement material would not occur in the same system while pumping wellbore cement into the well. As a result, with actions 150 to 180, the cement additive may be combined with the liquid on-the-fly while pumping the wellbore cement into the well at the same time, as distinguished from batch processes.

Action 120 and action 125 have been shown in dashed lines to indicate they may be implemented or not implemented. In action 120, the spacer polymer blend is added into a tank. In action 125, another portion of the liquid is pumped into the tank and combined with the spacer polymer blend, therein decreasing a ratio of spacer polymer to the liquid within the tank. A residency period within the tank may fully integrate the spacer polymer into the fluid, for example, by hydrating the polymer, and produce the spacer. In some embodiments, the second mixer is selectively isolated from the tank. The second mixer may be selectively isolated from the tank before the spacer polymer blend is received into the tank. The spacer may be pumped into the well using the product pump and bypassing the second mixer.

Action 160 and action 165 have been shown in dashed lines to indicate they may be implemented or not implemented. In action 160, the cement additive blend is added into the tank, separately from the spacer polymer blend. In action 165, another portion of the liquid is pumped into the tank and combined with the cement additive blend, therein decreasing a ratio of cement additive to liquid within the tank.

Figure 2:
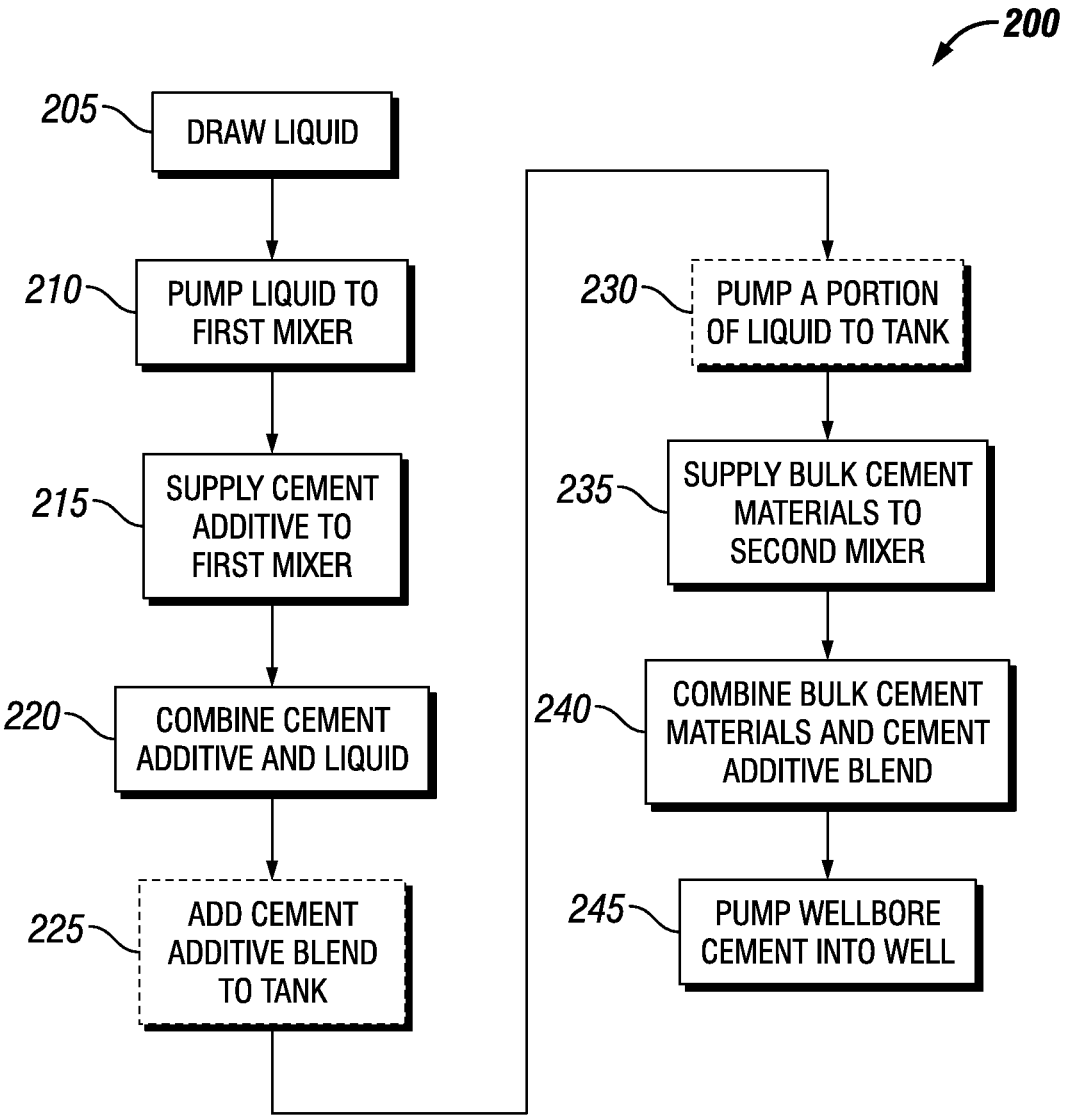

FIG. 2 shows a flow diagram of a well cementing method 200 according to another embodiment. Action 205 includes drawing a liquid from a liquid source. The liquid may be drawn to the liquid pump using the liquid pump. Action 210 includes pumping all of or a portion of the liquid to a first mixer. The liquid may be pumped to the first mixer using the liquid pump. Action 215 includes supplying a cement additive to the first mixer. In action 220, the cement additive is combined with the liquid to produce a cement additive blend. The cement additive blend may be used to produce a wellbore cement. Method 200 includes action 235 of supplying bulk cement materials to a second mixer. The bulk cement materials and cement additive blend are then combined within the second mixer to produce a wellbore cement in action 240. The wellbore cement is pumped into a well using a product pump in step 245.

Although actions 205 to 245 are represented as occurring sequentially, they are performed in a continuous process in the same sense as discussed above with regard to actions 150 to 180. As a result, with actions 205 to 145, the cement additive may be combined with the liquid on-the-fly while pumping the wellbore cement into the well at the same time, as distinguished from batch processes.

Action 225 and action 230 have been shown in dashed lines to indicate they may be implemented or not implemented. In action 225, the cement additive blend is added into the tank. In action 230, another portion of the liquid is pumped into the tank and combined with the cement additive blend, therein decreasing a ratio of cement additive to liquid within the tank.

The features and benefits of the disclosed methods may also be used in combination with other methods, systems, and compositions discussed herein even though not specifically indicated otherwise.

Figure 3:
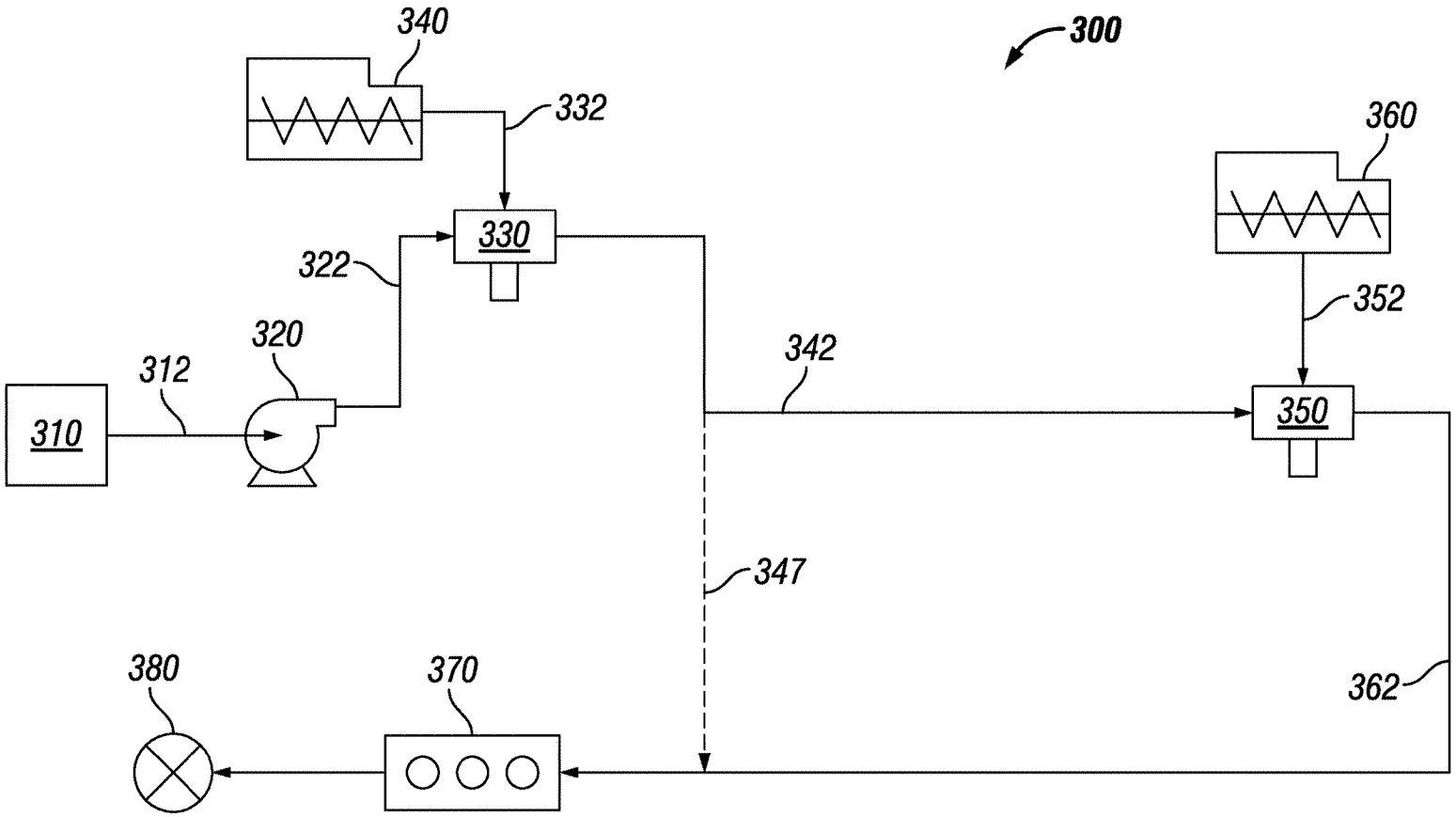
FIGS. 3-6 are process diagrams showing embodiments of well cementing systems.

FIG. 3 is a process diagram showing a well cementing system 300 according to one embodiment capable of on-the-fly mixing of spacer polymers and/or cement additives as well as bulk cement materials. Well cementing system 300 includes a liquid pump 320, a first mixer 330, an additive feeder 340, a second mixer 350, a cement feeder 360, and a product pump 370. Liquid pump 320 may be a centrifugal pump and product pump 370 may be a positive displacement pump. Such terms for pumps herein are in accordance with known usage in the petroleum industry. Liquid pump 320 supplies liquid to first mixer 330. Liquid pump 320 includes a feed line 312 connected to a liquid source 310 and a liquid discharge line 322 connected to first mixer 330. Additive feeder 340 is configured to supply additives, such as cement additives and spacer polymers, to first mixer 330 via an additive discharge path 332. The additives may be substantially dry additives. Additive feeder 340 may be a shaker with a screw type feeder configured to provide dry additives. Alternatively, additive feeder 340 may be a belt conveyor, gravity or pressurized feeder with an adjustable orifice, or other feeder that monitors the volume or weight supplied. First mixer 330 is configured to mix the additive and liquid to produce a blend. The blend may be a spacer polymer blend for producing a spacer or a cement additive blend for producing a wellbore cement. Known mixing technologies may be used in first mixer 330, for example, a rotary shear device, a high shear eductor, or an open vessel with a high shear head.

A blend discharge line 342 connects first mixer 330 to second mixer 350. Second mixer 350 is configured to further mix and process the blend from first mixer 330. Cement feeder 360 is configured to supply bulk cement materials for producing wellbore cement to second mixer 350 via a cement discharge path 352. A feed line 362 connects second mixer 350 with product pump 370, which is in communication with a well 380.

In operation, liquid pump 320 draws liquid from liquid source 310. All of or a portion of the liquid is pumped along feed line 312 and liquid discharge line 322 to first mixer 330 using liquid pump 320. A cement additive is supplied to first mixer 330 from additive feeder 340 via additive discharge path 332. The liquid and cement additive are combined within first mixer 330 to produce a cement additive blend. The cement additive blend is supplied to second mixer 350 via blend discharge line 342. A flow meter (not shown) may monitor the cement additive blend within blend discharge line 342.

Cement feeder 360 supplies bulk cement materials to second mixer 350 via cement discharge path 352. Second mixer 350 combines the bulk cement materials and the pre-wetted cement additive blend to produce a wellbore cement. Further water may be added as needed for the desired consistency of wellbore cement, or all the water needed may be provided via blend discharge line 342. Known mixing technologies may be used in second mixer 350, for example, a variable orifice meter eductor, a jet mixer, or an open vessel with a high shear head. The wellbore cement is provided to product pump 370 via feedline 362. Product pump 370 then pumps the wellbore cement into a well 380.

Before pumping the wellbore cement into well 380, it may be desirable to produce a spacer to precede the wellbore cement. In the event that system 300 is used to produce the spacer, a spacer line 347 from blend discharge line 342 to feedline 362 may be provided, bypassing second mixer 350. FIG. 3 shows spacer line 347 as a dashed line to indicate it might or might not be implemented.

When producing a spacer, all of or a portion of the liquid is pumped from liquid source 310 along feed line 312 and liquid discharge line 322 to first mixer 330 using liquid pump 320. A spacer polymer is supplied to first mixer 330 from additive feeder 340 via additive discharge path 332 or from a separate polymer feeder (not shown) via another discharge path (not shown) or the same additive discharge path 332. The spacer polymer may be supplied to first mixer 330 separate from the cement additive. The liquid and spacer polymer are combined within first mixer 330 to produce a spacer polymer blend. The spacer polymer blend may be used to produce a spacer. The amount of liquid supplied and the operation of first mixer 330 may be adjusted to compensate for the differing needs of spacer polymers and cement additives, as would be appreciated by one of ordinary skill in the art having the benefit of this disclosure.

A flow meter (not shown) may monitor the spacer polymer blend within blend discharge line 342. A weighting agent may be added to the spacer polymer blend. The spacer polymer blend may be provided to product pump 370 via spacer line 347. Residency time within first mixer 330, blend discharge line 342, spacer line 347, and feedline 362 may allow sufficient integration of the spacer polymer into the liquid to produce the spacer, depending on polymer hydration rate. For example, a suitable spacer is produced when a target density is achieved. When the target density is achieved, the viscosity of the spacer may be capable of carrying the weighting agent. Product pump 370 then pumps the spacer into well 380.

Figure 4:
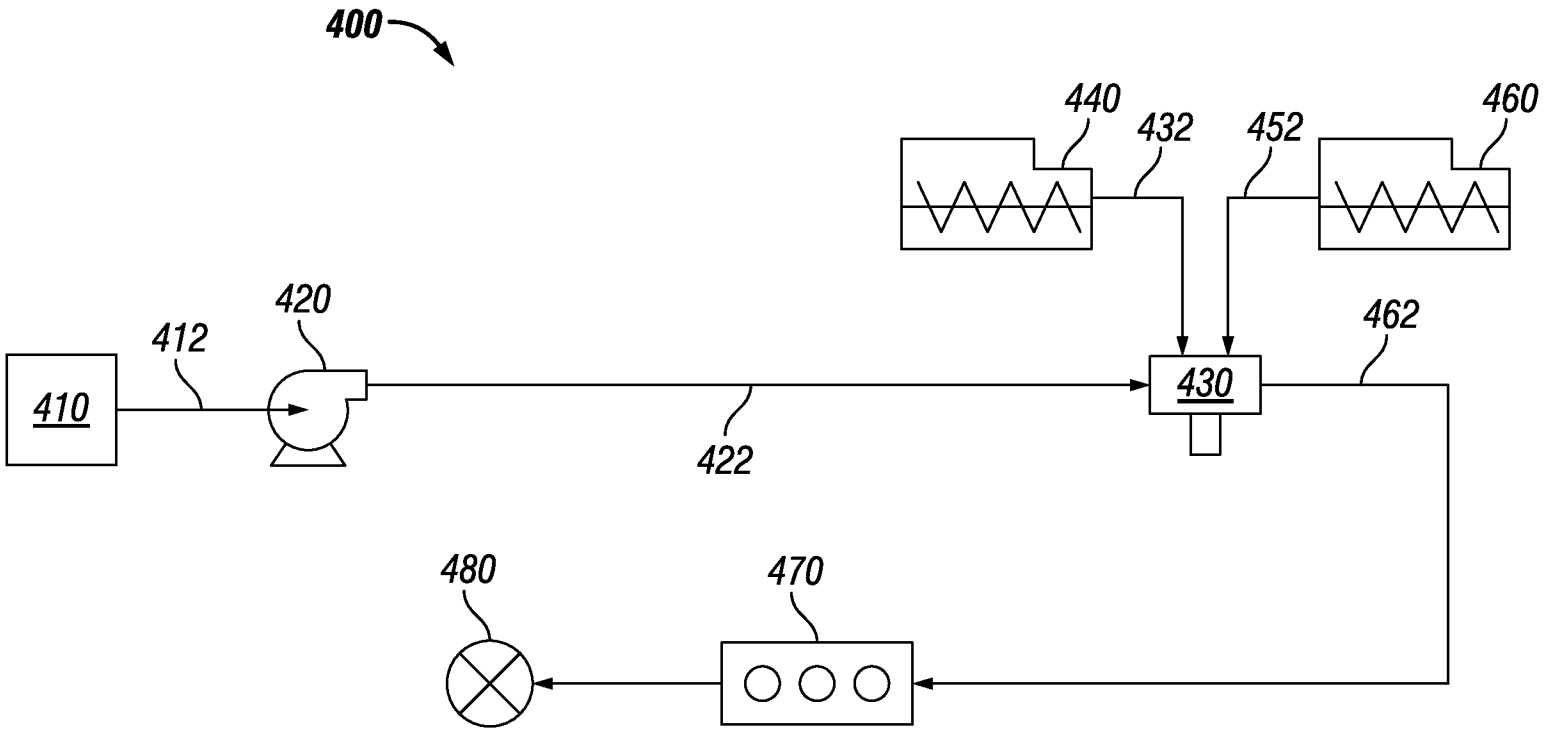

FIG. 4 is a process diagram showing a well cementing system 400 according to one embodiment capable of on-the-fly mixing of spacer polymers and/or cement additives as well as bulk cement materials. Well cementing system 400 includes a liquid pump 420, a mixer 430, an additive feeder 440, a cement feeder 460, and a product pump 470. Liquid pump 420 may be a centrifugal pump and product pump 470 may be a positive displacement pump. Liquid pump 420 supplies liquid to mixer 430. Liquid pump 420 includes a feed line 412 connected to a liquid source 410 and a liquid discharge line 422 connected to mixer 430. Additive feeder 440 is configured to supply additives, such as cement additives and spacer polymers, to mixer 430 via an additive discharge path 432. The additives may be substantially dry additives. Additive feeder 440 may be a shaker with a screw type feeder configured to provide dry additives. Examples include the same as listed for additive feeder 340.

Mixer 430 is configured to mix the additive and liquid to produce a blend. The blend may be a spacer polymer blend for producing a spacer or a cement additive blend for producing a wellbore cement. Cement feeder 460 is configured to supply bulk cement materials for producing wellbore cement to mixer 430 via a cement discharge path 452. Known mixing technologies may be used in mixer 430, for example, a rotary shear device, a high shear eductor, or an open vessel with a high shear head. Mixer 430 may be configured to combine the spacer polymer with the liquid and later to combine the cement additive and the liquid with the bulk cement materials. A feed line 462 connects mixer 430 with product pump 470, which is in communication with a well 480.

In operation, liquid pump 420 draws liquid from liquid source 410. The liquid is pumped along liquid discharge line 422 to mixer 430 using liquid pump 420. A cement additive is supplied to mixer 430 from additive feeder 440 via additive discharge path 432. The liquid and cement additive are combined within mixer 430 to produce a cement additive blend. Cement feeder 460 supplies bulk cement materials to mixer 430 via cement discharge path 452, wherein the bulk cement materials and the pre-wetted cement additive blend are combined to produce a wellbore cement. The wellbore cement is provided to product pump 470 via feedline 462. Product pump 470 then pumps the wellbore cement into a well 480.

Before pumping the wellbore cement into well 480, it may be desirable to produce a spacer to precede the wellbore cement. The liquid is pumped along liquid discharge line 422 to mixer 430 using liquid pump 420. A spacer polymer is supplied to mixer 430 from additive feeder 440 via additive discharge path 332 or from a separate polymer feeder (not shown) via another discharge path (not shown) or the same additive discharge path 432. The spacer polymer may be supplied to mixer 430 separate from the cement additive. The liquid and spacer polymer are combined within mixer 430 to produce a spacer polymer blend. The spacer polymer blend may be used to produce a spacer. The amount of liquid supplied and the operation of mixer 430 may be adjusted to compensate for the differing needs of spacer polymers and cement additives, as would be appreciated by one of ordinary skill in the art having the benefit of this disclosure.

A flow meter (not shown) may monitor the spacer polymer blend and a weighting agent may be added to the spacer polymer blend. The spacer polymer blend is provided to product pump 470 via feedline 462. Residency time within mixer 430 and feedline 462 may allow sufficient integration of the spacer polymer into the liquid to produce the spacer, depending on polymer hydration rate. Product pump 470 then pumps the spacer into well 480.

Figure 5:
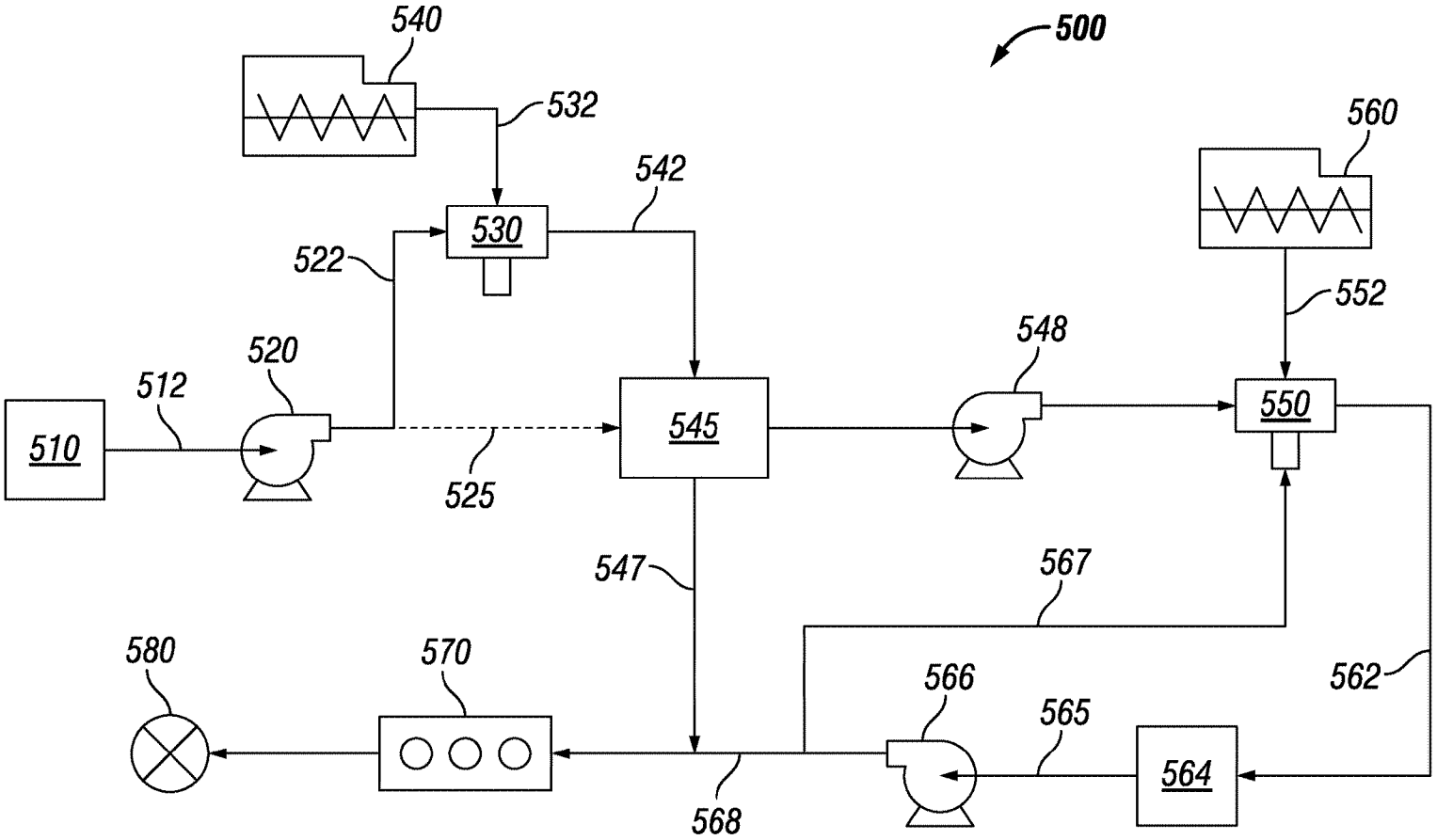

FIG. 5 is a process diagram showing a well cementing system 500 according to one embodiment capable of on-the-fly mixing of spacer polymers and/or cement additives as well as bulk cement materials. Well cementing system 500 includes a liquid pump 520, a first mixer 530, an additive feeder 540, a second mixer 550, a cement feeder 560, and a product pump 570. Liquid pump 520 supplies liquid to first mixer 530. Liquid pump 520 includes a feed line 512 connected to a liquid source 510 and a liquid discharge line 522 connected to first mixer 530. Additive feeder 540 is configured to supply additives, such as cement additives and spacer polymers, to first mixer 530 via an additive discharge path 532. The additives may be substantially dry additives. Additive feeder 540 may be a shaker with a screw type feeder configured to provide dry additives. Examples include the same as listed for additive feeder 340. First mixer 530 is configured to mix the additive and liquid to produce a blend. The blend may be a spacer polymer blend for producing a spacer or a cement additive blend for producing a wellbore cement. Known mixing technologies may be used in first mixer 530, for example, a rotary shear device, a high shear eductor, or an open vessel with a high shear head.

A blend discharge line 542 connects first mixer 530 to second mixer 550. Blend discharge line 542 may include a blend tank 545 configured to receive a blend from first mixer 530. Blend tank 545 may further be configured to at least temporarily hold the blend. A secondary liquid discharge line 525 may connect liquid pump 520 to blend tank 545. A spacer line 547 may connect blend tank 545 to product pump 570.

Second mixer 550 is configured to mix cement with the blend from first mixer 530. Cement feeder 560 is configured to supply bulk cement materials for producing wellbore cement to second mixer 550 via a cement discharge path 552. A feed line 562 connects second mixer 550 with product pump 570, which is in communication with a well 580. Feed line 562 may include a slurry tank 564 and a slurry pump 566. Slurry tank 564 is configured to receive and at least temporarily hold the blend from second mixer 560. A feed line 565 portion of feed line 562 connects slurry tank 564 to slurry pump 566, which may be used to charge product pump 570. A slurry circulation line 567 may be configured to direct contents of slurry tank 564 back to second mixer 550 via slurry pump 566 for further mixing and processing. A discharge line 568 portion of feed line 562 is configured to direct contents of slurry tank 564 via slurry pump 566 to product pump 570. In some embodiments, spacer line 547 may tie into discharge line 568 to feed product pump 570. In some embodiments, wellbore cement in slurry circulation line 567 may be injected into second mixer 550 in a manner to create a vacuum within second mixer 550 and draw materials, such as bulk cement materials, into second mixer 550.

In operation, liquid pump 520 draws liquid from liquid source 510. All of or a portion of the liquid is pumped along feed line 512 and liquid discharge line 522 to first mixer 530 using liquid pump 520. A cement additive is supplied to first mixer 530 from additive feeder 540 via additive discharge path 532. The liquid and cement additive are combined within first mixer 530 to produce a cement additive blend. The cement additive blend is supplied to blend tank 545 via blend discharge line 542. A flow meter (not shown) may monitor the cement additive blend within blend discharge line 542. The cement additive blend may be received and at least temporarily held within blend tank 545.

A first flow of liquid from liquid pump 520 may be directed to first mixer 530 via liquid discharge line 522 and a second flow of liquid from liquid pump 520 may be directed to blend tank 545 via secondary liquid discharge line 525. The first flow of liquid mixes with the cement additive. The second flow of liquid combines with the cement additive blend within blend tank 545 and therein reduces a ratio of cement additive to liquid within blend tank 545. The cement additive blend is further directed along blend discharge line 542 to second mixer 550 via a pump 548 between blend tank 545 and second mixer 550.

Cement feeder 560 supplies bulk cement materials to second mixer 550 via cement discharge path 552. Second mixer 550 combines the bulk cement materials and the pre-wetted cement additive blend to produce a wellbore cement. Further water may be added as needed for the desired consistency of wellbore cement, or all the water needed may be provided via blend discharge line 542. Known mixing technologies may be used in second mixer 550, for example, a variable orifice meter eductor, a jet mixer, or an open vessel with a high shear head. The wellbore cement is provided to product pump 570 via feedline 562. In feedline 562, the wellbore cement may be received and at least temporarily held within slurry tank 564 before being pumped by slurry pump 566 to either product pump 570 via discharge line 568 or back to second mixer 550 via slurry circulation line 567. Product pump 570 then pumps the wellbore cement into a well 580. Liquid pump 520, pump 548, and slurry pump 566 may be centrifugal pumps and product pump 570 may be a positive displacement pump.

Before pumping the wellbore cement into well 580, it may be desirable to produce a spacer to precede the wellbore cement. All of or a portion of the liquid is pumped from liquid source 510 along feed line 512 and liquid discharge line 522 to first mixer 530 using liquid pump 520. A spacer polymer is supplied to first mixer 530 from additive feeder 540 via additive discharge path 532 or from a separate polymer feeder (not shown) via another discharge path (not shown) or the same additive discharge path 532. The spacer polymer may be supplied to first mixer 530 separate from the cement additive. The liquid and spacer polymer are combined within first mixer 530 to produce a spacer polymer blend. The spacer polymer blend may be used to produce a spacer. The amount of liquid supplied and the operation of first mixer 530 may be adjusted to compensate for the differing needs of spacer polymers and cement additives, as would be appreciated by one of ordinary skill in the art having the benefit of this disclosure.

The spacer polymer blend is supplied to blend tank 545 via blend discharge line 542. A flow meter (not shown) may monitor the spacer polymer blend within blend discharge line 542. A weighting agent may be added to the spacer polymer blend. The spacer polymer blend is received and at least temporarily held within blend tank 545. Residency time within blend tank 545 may allow full integration of the spacer polymer into the liquid to produce a spacer, depending on polymer hydration rate.

A first flow of liquid from liquid pump 520 may be directed to first mixer 530 via liquid discharge line 522 and a second flow of liquid from liquid pump 520 may be directed to blend tank 545 via secondary liquid discharge line 525. The first flow of liquid may begin the hydration process with the spacer polymer. The second flow of liquid combines with the spacer polymer blend within blend tank 545 and therein reduces a ratio of spacer polymer to liquid within blend tank 545. After sufficient residency time, the spacer produced from the spacer polymer blend may be pumped along spacer line 547 to discharge line 568 and bypass second mixer 550. Product pump 570 then pumps the spacer into well 580.

Figure 6:
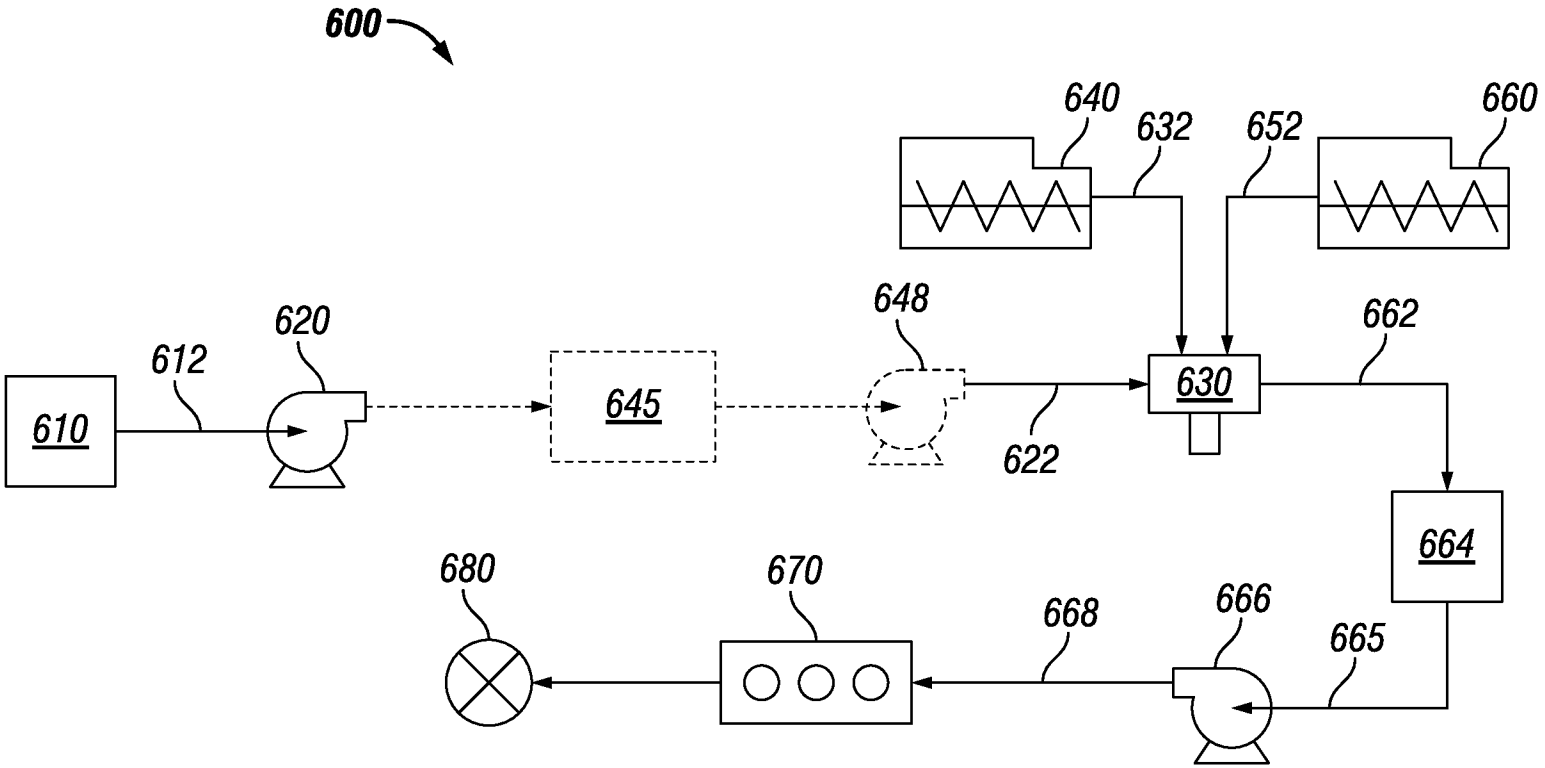

FIG. 6 is a process diagram showing a well cementing system 600 according to one embodiment capable of on-the-fly mixing of spacer polymers and/or cement additives as well as bulk cement materials. Well cementing system 600 includes a liquid pump 620, a mixer 630, an additive feeder 640, a cement feeder 660, and a product pump 670. Liquid pump 620 supplies liquid to mixer 630. Liquid pump 620 includes a feed line 612 connected to a liquid source 610 and a liquid discharge line 622 connected to mixer 630. Liquid discharge line 622 may include a tank 645 configured to receive liquid from liquid pump 620. The liquid may be at least temporarily held within tank 645 to provide a consistent liquid supply to a pump 648, which pumps the liquid to mixer 630. FIG. 6 shows tank 645 and pump 648 in dashed lines to indicate they might or might not be implemented.

Additive feeder 640 is configured to supply additives, such as cement additives and spacer polymers, to mixer 630 via an additive discharge path 632. The additives may be substantially dry additives. Additive feeder 640 may be a shaker with a screw type feeder configured to provide dry additives. Examples include the same as listed for additive feeder 340. Mixer 630 is configured to mix the additive and liquid to produce a blend. The blend may be a spacer polymer blend for producing a spacer or it may be a wellbore cement. Cement feeder 660 is configured to supply bulk cement materials for producing wellbore cement to second mixer 650 via a cement discharge path 652. Known mixing technologies may be used in mixer 630, for example, a rotary shear device, a high shear eductor, or an open vessel with a high shear head. Mixer 630 may be configured to combine the spacer polymer with the liquid and later to combine the cement additive and the liquid with the bulk cement materials.

A feed line 662 connects mixer 630 with product pump 670, which is in communication with a well 680. Feed line 662 may include a slurry tank 664 and a slurry pump 666. Slurry tank 664 is configured to receive and at least temporarily hold the blend or wellbore cement from mixer 630. A feed line 665 portion of feed line 662 connects slurry tank 664 to slurry pump 666, which may be used to charge product pump 670. A discharge line 668 portion of feed line 662 connects slurry pump 666 to product pump 670.

In operation, liquid pump 620 draws liquid from liquid source 610. The liquid is pumped along feed line 612 and liquid discharge line 622 to mixer 630 using liquid pump 620. A cement additive is supplied to mixer 630 from additive feeder 640 via additive discharge path 632. The liquid and cement additive are combined within mixer 630 to produce a cement additive blend. Cement feeder 660 supplies bulk cement materials to mixer 630 via cement discharge path 652, wherein the bulk cement materials and the pre-wetted cement additive blend are combined to produce a wellbore cement. The wellbore cement is provided to product pump 670 via feed line 662. In feed line 662, the wellbore cement may be received and at least temporarily held within slurry tank 664 before being pumped by slurry pump 666 to product pump 670 via discharge line 668. Product pump 670 then pumps the wellbore cement into a well 680. Liquid pump 620, pump 648, and slurry pump 666 may be centrifugal pumps and product pump 670 may be a positive displacement pump.

Before pumping the wellbore cement into well 680, it may be desirable to produce a spacer to precede the wellbore cement. The liquid is pumped from liquid source 610 along feed line 612 and liquid discharge line 622 to mixer 630 using liquid pump 620. A spacer polymer is supplied to mixer 630 from additive feeder 640 via additive discharge path 632 or from a separate polymer feeder (not shown) via another discharge path (not shown) or the same additive discharge path 632. The spacer polymer may be supplied to mixer 630 separate from the cement additive. The liquid and spacer polymer are combined within mixer 630 to produce a spacer polymer blend. The spacer polymer blend may be used to produce a spacer. The amount of liquid supplied and the operation of mixer 630 may be adjusted to compensate for the differing needs of spacer polymers and cement additives plus bulk cement, as would be appreciated by one of ordinary skill in the art having the benefit of this disclosure.

A flow meter (not shown) may monitor the spacer polymer blend and a weighting agent may be added to the spacer polymer blend. The spacer polymer blend is provided to product pump 670 via feed line 662. Residency time within mixer 630 and feed line 662 (including slurry tank 664) may allow full integration of the spacer polymer into the liquid to produce the spacer, depending on polymer hydration rate. Product pump 670 then pumps the spacer into well 680.

In compliance with the statute, the embodiments have been described in language more or less specific as to structural and methodical features. It is to be understood, however, that the embodiments are not limited to the specific features shown and described. The embodiments are, therefore, claimed in any of their forms or modifications within the proper scope of the appended claims appropriately interpreted in accordance with the doctrine of equivalents.

TABLE OF REFERENCE NUMERALS FOR FIGURES

300 well cementing system
310 liquid source
312 feed line
320 liquid pump
322 liquid discharge line
330 first mixer
332 additive discharge path
340 additive feeder
342 blend discharge line
350 second mixer
352 cement discharge path
360 cement feeder
362 feed line
370 product pump
380 well
400 well cementing system
410 liquid source
412 feed line
420 liquid pump
422 liquid discharge line
430 mixer
432 additive discharge path
440 additive feeder
452 cement discharge path
460 cement feeder
462 feed line
470 product pump
480 well
500 well cementing system
510 liquid source
512 feed line
520 liquid pump
522 liquid discharge line
525 secondary liquid discharge line
530 first mixer
532 additive discharge path
540 additive feeder
542 blend discharge line
545 tank
547 spacer line
548 pump
550 second mixer
552 cement discharge path
560 cement feeder
562 feed line
564 slurry tank
565 feed line
566 slurry pump
567 slurry circulation line
568 discharge line
570 product pump
580 well
600 well cementing system
610 liquid source
612 feed line
620 liquid pump
622 liquid discharge line
630 mixer
632 additive discharge path
640 additive feeder
645 tank
648 pump
652 cement discharge path
660 cement feeder
662 feed line
664 slurry tank
665 feed line
666 slurry pump
668 discharge line
670 product pump
680 well

What is claimed is:

1. A well cementing method comprising:

drawing liquid from a liquid source to a liquid pump using the liquid pump;

pumping liquid to a first mixer using the liquid pump, the first mixer including a rotary shear device that creates fluid shear using a component that rotates;

while pumping liquid to the first mixer, simultaneously performing the following spacer processes:

supplying a spacer polymer to the rotary shear device of the first mixer and therein combining the spacer polymer and liquid pumped to the first mixer and producing a spacer polymer blend;

producing a spacer from the spacer polymer blend; and pumping the spacer into a well using a product pump, the spacer processes thereby mixing the spacer polymer with liquid on-the-fly while pumping the spacer into the well; and after the supplying of the spacer polymer, the producing of the spacer, and the pumping of the spacer and while pumping liquid to the first mixer, simultaneously performing the following cement processes:

supplying a cement additive to the rotary shear device of the first mixer and therein combining the cement additive and liquid pumped to the first mixer and producing a cement additive blend;

producing a wellbore cement from the cement additive blend; and pumping the wellbore cement into the well following the spacer using the product pump, the cement processes thereby mixing the cement additive with liquid on-the-fly while pumping the wellbore cement into the well.

2. The method of claim 1, wherein all liquid from the liquid pump is pumped to the first mixer.

3. The method of claim 1, wherein the spacer polymer and the cement additive are dry.

4. The method of claim 1, further comprising:

while pumping liquid to the first mixer, also pumping liquid into a tank using the liquid pump;

adding the spacer polymer blend into the tank, the spacer polymer blend having a ratio of spacer polymer to liquid, and therein using liquid pumped into the tank for decreasing the ratio of spacer polymer to liquid within the tank; and separately adding the cement additive blend into the tank, the cement additive blend having a ratio of cement additive to liquid, and therein using liquid pumped into the tank for separately decreasing the ratio of cement additive to liquid within the tank.

5. The method of claim 1, wherein the producing of the wellbore cement from the cement additive blend comprises supplying a bulk cement material to a second mixer and therein combining the bulk cement material and the cement additive blend to produce the wellbore cement.

6. The method of claim 5, wherein the first mixer and the second mixer are the same mixer.

7. A well cementing method comprising:

drawing liquid from a liquid source to a liquid pump using the liquid pump;

pumping liquid to a first mixer using the liquid pump, the first mixer including a rotary shear device that creates fluid shear using a component that rotates; and while pumping liquid to the first mixer, simultaneously performing the following cement processes:

supplying a cement additive to the rotary shear device of the first mixer and therein combining the cement additive and liquid pumped to the first mixer and producing a cement additive blend;

supplying bulk cement materials to a second mixer separate from the first mixer and therein combining the bulk materials and the cement additive blend and producing a wellbore cement; and pumping the wellbore cement into a well using a product pump, the cement processes thereby mixing the cement additive with liquid on-the-fly while pumping the wellbore cement into the well; and before the supplying of the cement additive, the supplying of the bulk cement materials, and the pumping of the wellbore cement and while pumping liquid to the first mixer, simultaneously performing the following spacer processes:

supplying a spacer polymer to the rotary shear device of the first mixer and therein combining the spacer polymer and liquid pumped to the first mixer and producing a spacer polymer blend;

producing a spacer from the spacer polymer blend; and pumping the spacer into the well using the product pump, the spacer processes thereby mixing the spacer polymer with liquid on-the-fly while pumping the spacer into the well.

8. The method of claim 7, wherein all liquid from the liquid pump is pumped to the first mixer.

9. The method of claim 7, further comprising:

while pumping liquid to the first mixer, also pumping liquid into a tank using the liquid pump; and adding the cement additive blend into the tank, therein using liquid pumped into the tank for decreasing a ratio of cement additive to liquid within the tank.

10. The method of claim 9, further comprising:

adding the spacer polymer blend into the tank separately from the cement additive blend, therein using liquid pumped into the tank for decreasing a ratio of spacer polymer to liquid within the tank to produce the spacer;

selectively isolating the second mixer from the tank before the spacer polymer blend is received into the tank; and pumping the spacer into the well using the product pump, the product pump receiving flow from the tank, and bypassing the second mixer.

11. The method of claim 7, wherein:

the pumping of liquid occurs though a liquid discharge line from the liquid pump to the first mixer;

the supplying of the cement additive occurs from an additive feeder through an additive discharge path to the first mixer;

the second mixer is separate from the first mixer and the method further comprises supplying the cement additive blend through a blend discharge line from the first mixer to the second mixer;

the supplying of the bulk cement materials occurs from a cement feeder through a cement discharge path to the second mixer; and the pumping of the wellbore cement occurs through a feed line from the second mixer to the product pump.

12. The method of claim 11, wherein the feed line from the second mixer to the product pump comprises:

a slurry tank and a feed line from the second mixer to the slurry tank; and a slurry pump having a discharge line to the product pump and a feed line from the slurry tank to the slurry pump.

13. The method of claim 11, further comprising a polymer feeder or the additive feeder supplying a spacer polymer to the first mixer separate from supplying the cement additive and the first mixer combining liquid and spacer polymer to produce a spacer polymer blend.

14. The method of claim 13, wherein the blend discharge line further comprises a blend tank.

15. The method of claim 14, wherein the liquid discharge line of the liquid pump is connected to both the first mixer and the blend tank and the method further comprises directing a first flow of liquid through the liquid discharge line of the liquid pump to the first mixer and a second flow of liquid through the liquid discharge line of the liquid pump to the blend tank.

16. The method of claim 14, further comprising carrying the spacer polymer blend from the blend tank through a spacer line to the product pump.

17. A well cementing method comprising:

drawing liquid from a liquid source to a liquid pump using the liquid pump;

pumping liquid to a first mixer using the liquid pump, the first mixer including a rotary shear device that creates fluid shear using a component that rotates;

while pumping liquid to the first mixer, also pumping liquid into a tank using the liquid pump;

while pumping liquid to the first mixer, simultaneously performing the following spacer processes:

supplying a dry spacer polymer to the rotary shear device of the first mixer and therein combining the dry spacer polymer and liquid pumped to the first mixer and producing a spacer polymer blend;

adding the spacer polymer blend into the tank, the spacer polymer blend having a ratio of spacer polymer to liquid, and therein using liquid pumped into the tank for decreasing the ratio of spacer polymer to liquid within the tank;

producing a spacer from the spacer polymer blend; and pumping the spacer into a well using a product pump receiving flow from the tank, the spacer processes thereby mixing the dry spacer polymer with liquid on-the-fly while pumping the spacer into the well; and after the supplying of the spacer polymer, the adding of the spacer polymer blend, the producing of the spacer, and the pumping of the spacer and while pumping liquid to the first mixer, simultaneously performing the following cement processes:

supplying a dry cement additive to the rotary shear device of the first mixer and therein combining the dry cement additive and liquid pumped to the first mixer and producing a cement additive blend;

adding the cement additive blend into the tank, the cement additive blend having a ratio of cement additive to liquid, and therein using liquid pumped into the tank for decreasing the ratio of cement additive to liquid within the tank;

supplying a bulk cement material to a second mixer separate from the first mixer and therein combining the bulk cement material and the cement additive blend from the tank to produce a wellbore cement; and pumping the wellbore cement into the well following the spacer using the product pump, the cement processes thereby mixing the dry cement additive with liquid on-the-fly while pumping the wellbore cement into the well.

18. The method of claim 17, further comprising:

selectively isolating the second mixer from the tank before the spacer polymer blend is received into the tank; and pumping the spacer into the well using the product pump, the product pump receiving flow from the tank, and bypassing the second mixer.

19. The method of claim 17, wherein a liquid discharge line of the liquid pump is connected to both the first mixer and the tank and the method further comprises directing a first flow of liquid through the liquid discharge line of the liquid pump to the first mixer and a second flow of liquid through the liquid discharge line of the liquid pump to the tank.

* * * * *